US006021759A

United States Patent [19]

Okajima et al.

[11] Patent Number: 6,021,759

[45] Date of Patent: Feb. 8, 2000

[54] FUEL SUPPLY APPARATUS

[75] Inventors: Masahiro Okajima; Masaaki Kato, both of Kariya; Hiroyuki Kano, Gifu; Tsutomu Furuhashi, Anjo, all of Japan

[73] Assignee: Denso Corporation, Kariya, Japan

[21] Appl. No.: 09/127,870

[22] Filed: Aug. 3, 1998

[30] Foreign Application Priority Data

Aug. 29, 1997 [JP] Japan ..... 9-234075

[51] Int. Cl.[7] ..... F02M 41/00

[52] U.S. Cl. ..... 123/467; 123/510; 123/514

[58] Field of Search ..... 123/510, 467, 123/514, 516, 463, 457

[56] References Cited

U.S. PATENT DOCUMENTS

| | | | |
|---|---|---|---|
| 3,187,733 | 6/1965 | Heintz | 123/467 |
| 4,526,151 | 7/1985 | Tateishi | 123/468 |
| 5,297,523 | 3/1994 | Hafner | 123/468 |
| 5,365,906 | 11/1994 | Deweerdt | 123/467 |
| 5,752,486 | 5/1998 | Nakashima | 123/467 |
| 5,762,048 | 6/1998 | Yonekawa | 123/510 |

FOREIGN PATENT DOCUMENTS 58-180374 12/1983 Japan .

*Primary Examiner*—Carl S. Miller
*Attorney, Agent, or Firm*—Nixon & Vanderhye P.C.

[57] ABSTRACT

A fuel supply apparatus having a cross sectional area $S_0$ of a first low pressure fuel passage which is connected to a high pressure pump and which has a pressure regulator, a cross sectional area $S_1$ of an orifice formed between the first low pressure fuel passage and a second low pressure fuel passage, and a cross sectional area $S_2$ of the second low pressure fuel passage for supplying the low pressure fuel to the first low pressure fuel passage. Those cross sectional areas are set to satisfy a relationship of $S_1<S_0<S_2$ such that the pressure pulsation generated at the pressure regulator is reduced, and the noise produced by the fuel supply apparatus is reduced.

9 Claims, 2 Drawing Sheets

FUEL SUPPLY APPARATUS

CROSS REFERENCE TO RELATED APPLICATIONS

This application is based upon and claims priority from Japanese Patent Application No. Hei 9-234075, filed Aug. 29, 1997, the entire contents of which are incorporated herein by reference.

BACKGROUND OF THE INVENTION

1. Field of the Invention

The present invention relates to a fuel supply apparatus, and in particular, to a pulsation reducing structure of a fuel supply apparatus for reducing pulsation generated by an operation of a pressure regulator.

2. Description of Related Art

The pressure of fuel supplied to a high pressure pump has been conventionally reduced below a predetermined pressure by disposing a pressure regulator in the low pressure fuel passage for supplying the fuel pumped out from a fuel tank by the low pressure pump to the high pressure pump or in the low pressure fuel passage disposed in the high pressure pump.

However, when the valve member of the pressure regulator is lifted by the pressure of fuel to discharge the fuel, an opening between the valve member and a valve seat is disposed under negative pressure, and such negative pressure produces cavitation in the fuel. When such cavitation disappears, a large pressure wave is generated. Therefore, if the pressure wave is repeatedly generated according to the opening and the closing of the pressure regulator, it may cause a pressure pulsation.

The pressure pulsation generated by the pressure regulator is transmitted in the fuel pipe for supplying the low pressure fuel to the high pressure pump, and produces noises. In particular, if a fuel filter is disposed in the fuel pipe which connects a low pressure pump and the high pressure pump, and is mounted to a vehicle body, the vibration of the fuel filter caused by the pressure pulsation is transmitted to the vehicle body and cause large noise in the car.

A pulsation damper of diaphragm type may be connected to the fuel pipe to reduce such pressure pulsation. However, the frequency of the pressure pulsation generated by the pressure regulator is high, and the pulsation damper of diaphragm type can not respond to such high frequency of the pressure pulsation. Furthermore, if the amplitude of the pressure pulsation is large, it may be a problem that the diaphragm may be broken.

SUMMARY OF THE INVENTION

It is an object of the present invention to provide a fuel supply apparatus which reduces the pressure pulsation generated by the operation of the pressure regulator.

According to a fuel supply apparatus of the present invention, a cross sectional area $S_0$ of a first low pressure fuel passage which is connected to a high pressure pump and which has a pressure regulator, a cross sectional area $S_1$ of an orifice formed between the first low pressure fuel passage and a second low pressure fuel passage, and a cross sectional area $S_2$ of the second low pressure fuel passage for supplying the low pressure fuel to the first low pressure fuel passage are set to satisfy a relationship of $S_1<S_0<S_2$.

Therefore, the pressure pulsation generated at the pressure regulator and normally turned and reflected at a boundary between the first low pressure fuel passage and the orifice is canceled by the pressure pulsation reversely turned and reflected at a boundary between the orifice and the second low pressure fuel passage. Therefore, the pressure pulsation generated at the pressure regulator is reduced, and the noise produced by the fuel supply apparatus is reduced.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

DETAILED DESCRIPTION OF PREFERRED EMBODIMENTS

The preferred embodiment of the present invention will be hereinafter described with reference to the drawings.

Figure 3:
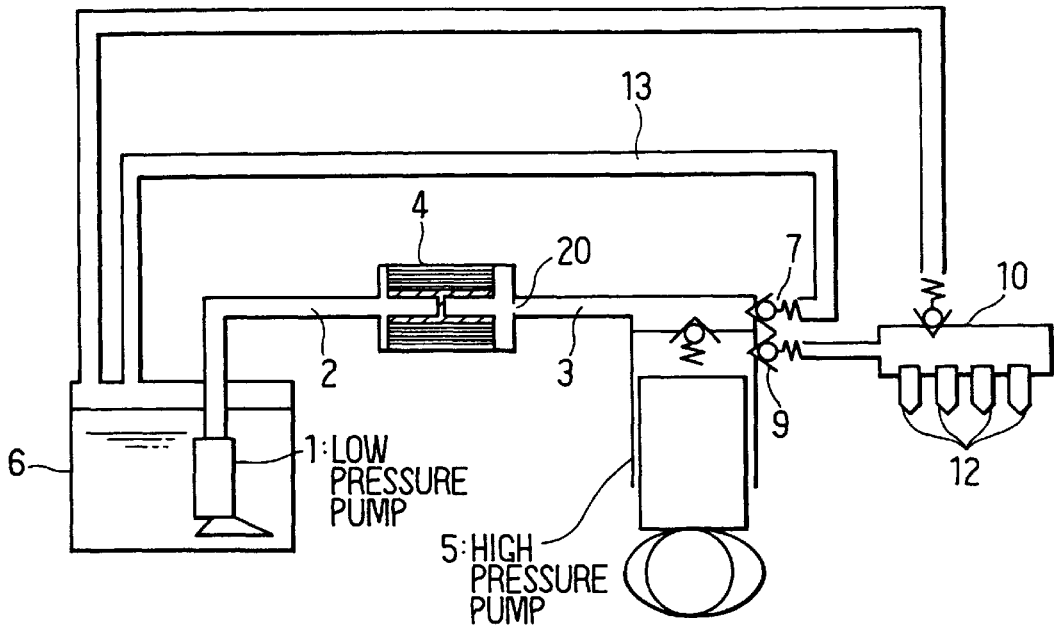
FIG. 3 is a schematic constitution showing a fuel supply system including the fuel supply apparatus of the embodiment.

A fuel supply system using a fuel supply apparatus according to a preferred embodiment of the present invention is shown in FIG. 3. The fuel supply apparatus comprises fuel pipes 2 and 3, a fuel filter 4, a high pressure pump 5, a pressure regulator 7 and a fuel return pipe 13 which will be described below. Foreign substance is removed, from the fuel pumped up from a fuel tank 6 by a low pressure pump 1, by the fuel filter 4 disposed between the fuel pipe 2 and the fuel pipe 3. The fuel passed through the fuel filter 4 is pressurized by the high pressure pump 5, and is supplied to injectors 12, which are fuel injection devices fixed to a branch pipe 10, from a delivery valve 9. The fuel pipes 2 and 3 and the fuel filter 4 are included in a low pressure fuel passage.

The pressure regulator 7 regulates the pressure of the fuel to be sucked into the high pressure pump 5 to maintain it below a predetermined pressure, and is connected to the low pressure fuel passage in the high pressure pump 5. When the pressure of the sucked fuel exceeds a predetermined pressure, the pressure regulator 7 opens its valve to return the excessive fuel to the fuel tank 6 through a fuel return pipe 13. The fuel return pipe 13 is also included in the low pressure fuel passage.

Figure 1:
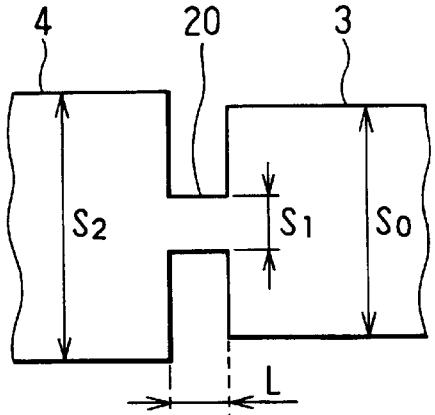
FIG. 1 is a schematic illustration showing a pulsation reducing structure according to an embodiment of the present invention.

As shown in FIG. 1, an orifice 20 is formed at the fuel exit, which is a connection part of the fuel filter 4 and the fuel pipe 3, of the fuel filter 4. If the cross sectional area of the fuel pipe 3 connected to the high pressure pump 5 is $S_0$, and the cross sectional area of the orifice 20 is $S_1$, and the cross sectional area of the fuel filter 4, disposed at the position opposite to the high pressure pump 5 of the orifice 20, is $S_2$, then there is a relationship of $S_1<S_0<S_2$. The pulsation reducing structure is formed by the relationship of $S_1<S_0<S_2$.

Next, operations of the above-mentioned pressure pulsation reducing structure will be explained.

When the pressure of the fuel sucked into the high pressure pump 5 becomes not less than a predetermined pressure, the pressure regulator 7 opens its valve to return the excessive fuel to the fuel tank 6 via the fuel return pipe 13. When the valve of the pressure regulator 7 is detached from a valve seat thereof and the fuel passes through an opening between the valve and the valve seat, negative pressure is generated at the opening and produces cavitation. Furthermore, when the produced cavitation disappears, a large pressure wave is generated. When the pressure wave is generated according to the operations of the pressure regulator 7, a pressure pulsation is generated.

Figure 2A:
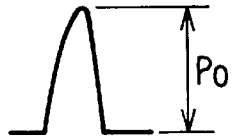
FIGS. 2A through 2E are schematic illustration to explain the pulsation reducing structure according to the embodiment of the present invention.
Figure 2B:
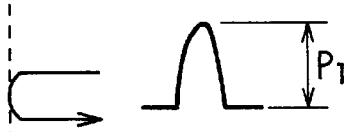

When the pressure wave with pressure $P_0$ is transmitted to the orifice 20 from the pressure regulator 7 via the fuel pipe 3 as shown in FIGS. 1 and 2A, a part of the pressure wave is normally turned and reflected as shown in FIG. 2B, according to a difference in cross sectional area at the boundary between the fuel pipe 3 and the orifice 20. The pressure $P_1$ of the reflected pressure pulsation is described by the following equation (1):

$$P_1=((S_0-S_1)/(S_0+S_1))\times P_0 \quad (1)$$

In this embodiment, the word of "normally turned" means that the direction of the pressure is not changed and the word of "reversely turned" means that the direction of the pressure is changed.

Figure 2C:
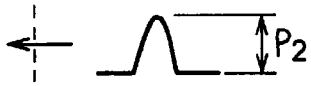

As shown in FIG. 2C, the pressure $P_2$ of the pressure pulsation passed through the boundary between the fuel pipe 3 and the orifice 20 is described by the following equation (2):

$$P_2=(2S_1/(S_0+S_1))\times P_0 \quad (2)$$

Figure 2D:
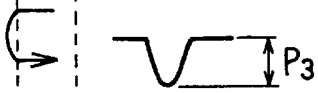

As shown in FIG. 2D, a part of the pressure pulsation passed through the boundary between the fuel pipe 3 and the orifice 20 is reversely turned and reflected at the boundary between the orifice 20 and the fuel filter 4. The pressure $P_3$ of the reflected pressure pulsation is described by the following equation (3):

$$P_3=((2S_1/(S_0+S_1))\times(S_1-S_2)/(S_1+S_2))\times P_0 \quad (3)$$

$P_3$ is negative because $(S_1-S_2)<0$.

Figure 2E:
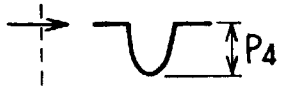

As shown in FIG. 2E, the pressure $P_4$ of the pressure pulsation, which is reversely turned and reflected at the boundary between the orifice 20 and the fuel filter 4, and which passed through the boundary between the fuel pipe 3 and the orifice 20, is described by the following equation (4):

$$P_4=((2S_1/(S_0+S_1))\times(S_1-S_2)/(S_1+S_2))\times P_0 \quad (4)$$

The pressure pulsation shown in FIG. 2B which is normally turned and reflected at the boundary between the fuel pipe 3 and the orifice 20 overlaps, at the fuel pipe 3 side of the orifice 20, the pressure pulsation shown in FIG. 2E which is reversely turned and reflected at the boundary between the orifice 20 and the fuel filter 4 and passed through the boundary between the fuel pipe 3 and the orifice 20. Such overlapped pressure P is described by the following equation (5):

$$P=((S_0-S_1)/(S_0+S_1)+(2S_1/(S_0+S_1))^2\times(S_1-S_2)/(S_1+S_2))\times P_0 \quad (5)$$

The waveforms of the pressure pulsations shown by the equation (1) and the equation (4) are shifted from each other according to the difference of the round-trip distance of the orifice 20 (that is L×2), and the directions of the pressure thereof are opposite to each other. Therefore, by making the length L of the orifice 20 as short as possible to reduce a shift in the waveform, the pressure pulsation shown in FIG. 2B and the pressure pulsation shown in FIG. 2E cancel each other out to reduce the pressure P.

In the present preferred embodiment, the inner diameter of the fuel pipe 3 is 5.5 mm and the inner diameter of the fuel filter 4 is 60 mm. Therefore, the coefficient of the pressure $P_0$ in the right side of the equation (5) can be reduced to approximately zero by adjusting the inner diameter d of the orifice 20. If the inner diameter d of the orifice 20 is too small, the necessary amount of fuel may not be supplied to the high pressure pump 5. Furthermore, if the fuel pumped up by the low pressure pump 1 is blocked by the orifice 20, the pressure of the fuel in the fuel pipe 2 increases and the low pressure pump 1 might be broken.

Figure 4:
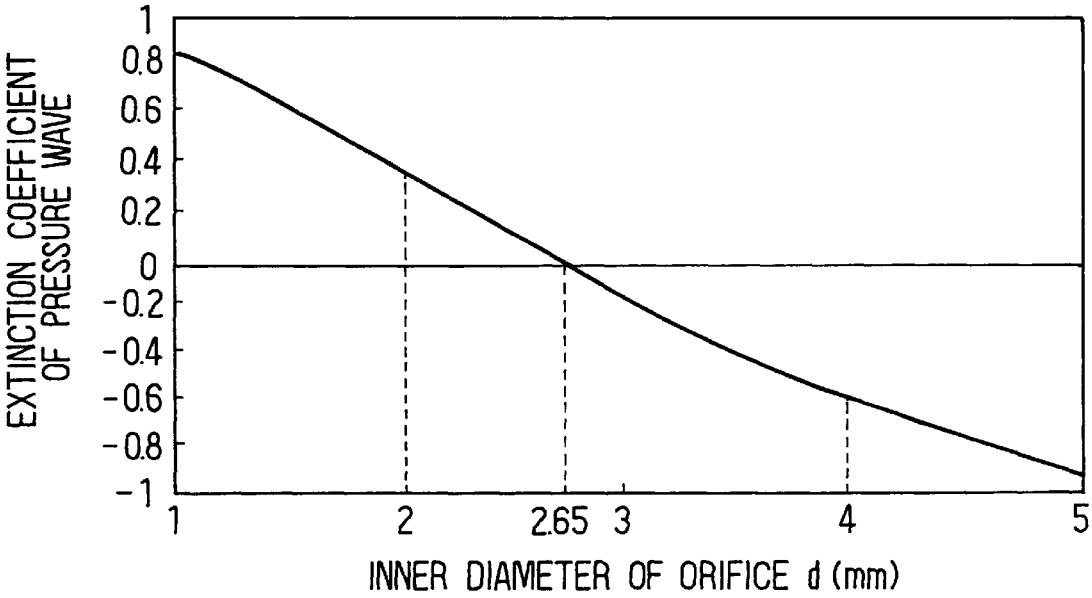
FIG. 4 is a characteristic drawing for showing a relationship between the diameter d of an orifice and a pressure wave extinction coefficient according to the embodiment.

In consideration of the amount of fuel supplied to the high pressure pump 5 and the pressure of the fuel in the fuel pipe 2, when the inner diameter of the fuel pipe 3 is 5.5 mm and the inner diameter of the fuel filter 4 is 60 mm, as described above, the right side of the equation (5) can be approximately zero by setting the inner diameter d of the orifice 20 at 2.65 mm as shown in FIG. 4.

Furthermore, the pressure pulsation can be reduced to some extent by setting the inner diameter d of the orifice 20 at 2 mm≦d≦4 mm. Since the length L of the orifice 20 is 1 mm . in other words, both ends of the orifice 20 are brought closer each other, the pressure pulsation normally turned and reflected at the boundary between the cross sectional area $S_0$ and the cross sectional area $S_1$ of the orifice 20 and the pressure pulsation reversely turned and reflected at the boundary between the cross sectional area $S_1$ of the orifice 20 and the cross sectional area $S_2$ are shifted very little in time, and cancel each other. Therefore, the pressure pulsation is reliably reduced.

Since the pressure pulsation is reduced when it passes the boundary of the passage area $S_1$ of the orifice and the passage area $S_2$, the noises produced by the pressure pulsation transmitted to the passage area $S_2$ are made smaller.

Further, since the fuel supply apparatus according to the present invention does not reduce the pressure pulsation by the displacement of a movable member as in the case of the damper of diaphragm type, the members are hardly broken even if the amplitude of the pressure pulsation becomes large.

Furthermore, since the pressure pulsation is reduced by a simple structure of adjusting the cross sectional area, it is easy to manufacture the apparatus and manufacturing costs is reduced.

Furthermore, since the fuel filter 4 has the cross sectional area $S_2$, it is not necessary to manufacture a structure for forming the cross sectional area $S_2$. Further, although a distance between the pressure regulator 7 and the fuel filter 4 is made smaller by disposing the fuel filter 4 in the fuel pipes 2 and 3 to make the frequency of the pressure pulsation transmitted to the fuel filter 4 from the pressure regulator 7 higher, the pressure pulsation is reduced by a difference in the cross sectional area irrespective of the higher frequency.

In the above-mentioned preferred embodiment of the present invention, one orifice 20 is formed at the fuel exit of the fuel filter 4. However, several orifices may be formed in the same plane instead. In this case, since each of the plurality of orifices reduces the pressure pulsation, the pressure pulsation is reduced further effectively. However, the diameter d of each orifice is required to be 2 mm≦d≦4 mm.

Although the orifice 20 is provided in the fuel pipes 2 and 3 of the fuel supply side to constitute a pressure reducing structure, the orifice may be formed in the fuel return pipe 13 instead.

Although the fuel filter 4 is provided between the fuel pipes 2 and 3, the fuel filter 4 may be connected to the low pressure pump 1 instead. Further, although the pressure regulator 7 is connected to the high pressure pump 5, the pressure regulator 7 may be installed in the fuel pipe, which connects the low pressure pump 1 and the high pressure pump 5, at the high pressure pump 5 side of the fuel filter 4.

Although the present invention has been described in connection with the preferred embodiments thereof with reference to the accompanying drawings, it is to be noted that various changes and modifications will be apparent to those skilled in the art. Such changes and modifications are to be understood as being included within the scope of the present invention as defined in the appended claims.

What is claimed is:

1. A fuel supply apparatus for supplying high pressure fuel to a fuel injection device, comprising:

a high pressure pump for producing high pressure fuel and for supplying high pressure fuel to the fuel injection device;

a first low pressure fuel passage that has a cross sectional area of $S_0$, and that is connected to said high pressure pump for supplying low pressure fuel to said high pressure pump;

a second low pressure fuel passage that has a cross sectional area of $S_2$, and that is connected to said first low pressure fuel passage for supplying said low pressure fuel to said first low pressure fuel passage, said second low pressure fuel passage having an orifice that has a cross sectional area of $S_1$ between said first low pressure fuel passage and said second low pressure fuel passage; and a pressure regulator installed in said first low pressure fuel passage for regulating pressure of the low pressure fuel, wherein;

said cross sectional areas $S_0$, $S_1$ and $S_2$ are set to satisfy the following relationship:

$$S_1<S_0<S_2.$$

2. A fuel supply apparatus according to claim 1, wherein:

said second low pressure fuel passage includes a fuel filter having the cross sectional area of $S_2$, an inlet and an outlet; and said orifice is formed at said outlet of said fuel filter.

3. A fuel supply apparatus according to claim 1, wherein a length L of said orifice satisfies the following equation:

$$L \leqq 1 \text{ mm}.$$

4. A fuel supply apparatus according to claim 3, wherein an inner diameter d of said orifice satisfies the following equation:

$$2 \text{ mm} \leqq d \leqq 4 \text{ mm}.$$

5. A fuel supply apparatus according to claim 1, wherein an inner diameter d of said orifice satisfies the following equation:

$$2 \text{ mm} \leqq d \leqq 4 \text{ mm}.$$

6. A fuel supply apparatus according to claim 5, wherein:

an inner diameter of said first low pressure fuel passage is 5.5 mm; and an inner diameter of said second low pressure fuel passage is 60 mm.

7. A fuel supply apparatus according to claim 1, wherein:

an inner diameter of said first low pressure fuel passage is 5.5 mm;

an inner diameter of said second low pressure fuel passage is 60 mm; and an inner diameter of said orifice is 2.65 mm.

8. A fuel supply apparatus according to claim 1, wherein:

said orifice has a downstream opening for reflecting a part of a pressure wave generated by said pressure regulator and for allowing rest of said pressure wave to pass said downstream opening against a fuel flow, and has a upstream opening for reflecting a part of said rest of said pressure wave, such that said reflected pressure wave reflected at said downstream opening and said reflected pressure wave reflected at said upstream opening cancel each other.

9. A fuel supply apparatus according to claim 8, wherein:

a distance between said upstream opening and said downstream opening is minimized to cancel said reflected pressure wave reflected at said downstream opening and said reflected pressure wave reflected at said upstream opening.

* * * * *